US009433840B2

(12) United States Patent
Jeanneau et al.

(10) Patent No.: US 9,433,840 B2
(45) **Date of Patent: *Sep. 6, 2016**

(54) BLADE OF/FOR A HOCKEY STICK

(71) Applicant: Sport Maska Inc., Montreal (CA)

(72) Inventors: Philippe Jeanneau, Lachine (CA); Pascal Gosselin, Delson (CA)

(73) Assignee: SPORT MASKA INC., Montreal, Quebec ( * ) Notice: Subject to any disclaimer, the term of this patent is extended or adjusted under 35 U.S.C. 154(b) by 0 days.

This patent is subject to a terminal disclaimer.

(21) Appl. No.: 14/323,480

(22) Filed: Jul. 3, 2014

(65) Prior Publication Data

US 2014/0315669 A1 Oct. 23, 2014

Related U.S. Application Data

(63) Continuation of application No. 13/101,619, filed on May 5, 2011, now Pat. No. 8,801,550.

(51) Int. Cl.
*A63B 59/14* (2006.01)

(52) U.S. Cl.
CPC ..... *A63B 59/14* (2013.01); *A63B 59/70* (2015.10); *A63B 60/48* (2015.10); *A63B 2060/004* (2015.10); *A63B 2102/24* (2015.10); *A63B 2209/00* (2013.01)

(58) Field of Classification Search
CPC .. A63B 59/14; A63B 59/12; A63B 59/0007; A63B 59/70; A63B 2102/24; A63B 2102/22; A63B 2060/004
USPC ..... 473/560–563
See application file for complete search history.

(56) References Cited

U.S. PATENT DOCUMENTS

| | | | |
|---|---|---|---|
| 2,912,245 | A | 11/1959 | Gardner et al. |
| 5,429,352 | A | 7/1995 | Leclerc |
| 5,558,326 | A | 9/1996 | Adamson et al. |
| 5,607,154 | A | 3/1997 | Meumann et al. |
| 5,697,857 | A | 12/1997 | Christian et al. |
| 5,810,682 | A | 9/1998 | Carruthers |
| 5,836,841 | A | 11/1998 | Fell |
| 5,839,977 | A | 11/1998 | Maurer et al. |
| 5,898,939 | A | 5/1999 | Schramm |
| 6,019,691 | A | 2/2000 | Hilborn |
| 6,085,354 | A | 7/2000 | Wilder et al. |
| 6,183,383 | B1 | 2/2001 | McSorley |
| 6,273,835 | B1 | 8/2001 | Battis et al. |
| 6,364,793 | B1 | 4/2002 | Valarik |

(Continued)

FOREIGN PATENT DOCUMENTS

| | | |
|---|---|---|
| WO | 91/02831 | 3/1991 |
| WO | 02089926 | 11/2002 |

*Primary Examiner* — Mark Graham
(74) *Attorney, Agent, or Firm* — Norton Rose Fulbright Canada

(57) ABSTRACT

A hockey stick blade with a rear face and a front face having a heel portion, a toe portion spaced apart from the heel portion, and a central portion intermediate the toe and heel portions. The front face has a textured zone defined by a plurality of front protrusions, and a front face reduced-texture zone. At least part of the textured zone extends in the central portion from a lower edge of the blade. The reduced-texture zone extends adjacent the front face textured zone. At least part of the reduced-textured zone extends in the central portion from an upper edge of the blade and in the toe portion from the lower edge of the blade. The textured zone extends in the toe portion upwardly from the reduced-texture zone.

19 Claims, 8 Drawing Sheets

(56) References Cited

U.S. PATENT DOCUMENTS

| | | | | |
|---|---|---|---|---|
| 6,471,609 | B1 | 10/2002 | Fell | |
| 7,044,870 | B2 | 5/2006 | Pagotto | |
| D523,497 | S | 6/2006 | Johnson et al. | |
| 7,294,072 | B2 | 11/2007 | Montecchia | |
| 8,801,550 | B2 * | 8/2014 | Jeanneau et al. | 473/563 |
| 2009/0324862 | A1 | 12/2009 | Wells | |

* cited by examiner

BLADE OF/FOR A HOCKEY STICK

CROSS-REFERENCE TO RELATED APPLICATION

The present application is a continuation of U.S. application Ser. No. 13/101,619, which was filed on May 5, 2011, the entire contents of which is incorporated by reference herein.

TECHNICAL FIELD

The present invention relates generally to blades of or for hockey sticks.

BACKGROUND

Hockey is a high paced, physically demanding sport that requires a high level of skill and endurance from the players. To stay on top of their game, hockey players are in need of reliable high performance equipment that enhances their game skills. As hockey sticks are used to pass the puck to other players and to shoot at the opposing team's net to score goals, they are considered a key piece of equipment of any hockey player. Any slight improvement in a player's maneuverability, responsiveness and performance (including puck handling and control, shot accuracy, and shot speed) with a particular stick can have a significant impact on the player's game.

Conventional hockey sticks have a shaft and an adjoining blade. The blade has a body and a neck that connects the body to the shaft. The blade has a heel at the end of the body below the neck and a toe disposed at end of the body opposite the heel. The body has two main faces, a front face and a rear face, that each extend from the heel to the toe. The front face has the puck striking surface of the blade.

Conventional hockey stick blades are curved (when viewed from above) to form a forward facing "pocket". They may also be "twisted" such that when the stick is being correctly held on the playing surface the blade appears twisted when viewed from above. Thus, conventional hockey stick blades often have a three dimensional curvature. The specific curvature of a blade is one of the physical characteristics of a blade that is very important to skilled hockey players. The curvature of the blade plays a significant role in a player's ability both to control the puck while the player is moving and for accuracy when the player is shooting. Each player has their own preferences with regard to the curvature of the blades that they use allowing them to have their best performance. In this respect, when one goes to buy a conventional hockey stick each manufacturer typically sells the same model of stick at the retail level with many different shaped curvatures.

There are several different kinds of shots that a player can take with a stick. These include "shovel shots", "wrist shots", "snap shots", "slap shots", "backhand shots" and "one timers". (These shots are all well known to those skilled in the art of hockey.) These different types of shots each require the player to carry out a different motion with their stick. The location of puck with respect to the blade, the movement of the puck along the striking surface of the blade, and the travel of the puck, all may vary between these different types of shots. Thus, different physical characteristics of the stick and the blade may vary in importance with respect to the different types of shots.

In many shots, prior to leaving contact with the blade, the puck is translationally moved along the face of the blade (whether horizontally, vertically or some combination of both), and this movement is a key factor in the shot being performed correctly.

Further, when the player is moving with the puck, the player may move the puck along the blade.

Conventional hockey stick blades have smooth faces. As is known in the art, having a smooth blade face can make the handling of the puck with the stick challenging as there is little friction between the blade and puck. This may make it difficult to control the relative position of the puck and the blade, as well to accurately move the puck along the surface of the blade when the two are in contact. This difficulty is known in the art.

To overcome this difficulty, hockey players often wrap hockey tape around their blades. Many players do this completely from heel to toe, although there are others that wrap only a portion of the blade. Hockey tape is a self-adhesive cloth tape that is made of either natural or synthetic fibers. Being cloth, the non-adhesive side of the tape is rough. When a blade is wrapped with hockey tape, the portions thereof that have exposed non-adhesive surface will have an increased ability to generate friction because of the roughness of the "cloth" structure as compared with the smooth surface of the underlying blade. The players thus wrap their blades to increase the amount of friction between the blade and the puck, which makes it more difficult for the puck to slide along a face of the blade. This hopefully makes it easier to more accurately position one with respect to the other and control the puck's movement. To further increase their control over the puck, some players even add waxes or other chemical coatings on top of the tape to provide for an additional adherence between the blade and the puck.

An alternative to traditional hockey stick tapes is the newer hockey blade tape. Hockey blade tape is a sheet of a synthetic material that has a smooth surface on one side and a ridged surface on the other. The sheet is shaped so as to have the shape of the entire front/rear side of a hockey stick blade. In use, the smooth side of the blade tape is adhered to the front/rear side (as the case may be) of the hockey stick, either via selfadherence or the application of a glue, leaving the ridged side exposed to be available to contact the puck. The ridged surface of the blade tape will have increased friction with the puck than will the smooth surface of the blade.

In addition to the advantages described above, in many cases, the increased fiction between the puck and the blade (no matter which of the previously described methods is used to cause it) has the additional effect of imparting a spinning motion to the puck when the puck is translationally moved across a face of the blade. Depending on the shot and the player, the puck may retain this spinning motion as it leaves the stick and continues along its shot trajectory. This spinning motion will likely beneficially improve the shot as it gives the puck a gyroscopic effect. This means that the puck will resist angular movement of its axis of rotation, and it will likely be easier to cause the puck's trajectory to be as desired and make unwanted deviations from that trajectory less likely.

For these reasons, the use of hockey stick tape or hockey blade tape is quite common. Nonetheless, improvements in hockey sticks in this respect are desirable.

SUMMARY

It is an object of the present invention to provide for an improved hockey stick blade as compared with at least some conventional hockey stick blades.

Thus in one aspect, as embodied and broadly described herein there is a provided a hockey stick blade connectable to a proximal end of a hockey stick. The hockey stick blade has: a toe, a heel, rear face, and front face. The front face has a striking surface intermediate the toe and the heel, and plurality of front protrusions forming a front face textured zone extending along a portion of the front face proximate the toe and the striking surface. The front protrusions are shaped to be engageable with a puck to hinder slippage of the puck along the front face when the puck is in contact with the front protrusions. The front face also has a front face reduced-texture zone.

In one aspect, there is provided a hockey stick blade comprising: a rear face; a front face opposite the rear face, the front face having a heel portion, a toe portion spaced apart from the heel portion, and a central portion intermediate the toe and heel portions, the front face further having: a front face textured zone defined by a plurality of front protrusions, at least part of the front face textured zone extending in the central portion from a lower edge of the blade, and a front face reduced-texture zone being less textured than the front face textured zone and extending adjacent the front face textured zone, at least part of the front face reduced-textured zone extending in the central portion from an upper edge of the blade and extending in the toe portion from the lower edge of the blade, the front face textured zone extending in the toe portion upwardly from the front face reduced-texture zone.

The present inventors have realized that in certain situations, conventional hockey stick tape and hockey blade tape are not optimal because when they are applied to the blade (as they are conventionally applied), they are not positioned on the blade so as to take into account at least some of the various types of shots that the player will take with the stick, the movement of the puck along the blade surface during each of those types of shots, whether or not those various shot types would positively or negatively affected by the presence of friction-increasing material on the blade portions that the puck contacts during that particular shot type. They are simply applied from blade top to blade bottom over most (and generally all) of the striking surface. The present inventors have realized that, taking into account the normal usage of hockey stick and the normal shots that are taken with it, more optimal blade friction pattern designs are in some cases possible. Specifically the present inventors have realized that some portions of front face should be textured (so as to create increased friction with the puck) ("textured zones") and others either should not be so textured (so as not to materially increase friction with the puck) ("non-textured zones") and/or should be less textured than the textured zone (so as to have increased friction with the puck as compared with the nontextured zone but decreased friction with the puck as compared with the textured-zone) ("less-textured zones"). Non-textured zones and less-textured zones are hereinafter collectively referred to as "reduced-texture zones"). The exact position of the textured and reduced-texture zones, and whether the reduced-texture zones are non-textured zones and/or less-textured zones, may vary depending on the player and the stick.

In some embodiments, the front face textured zone is formed along a lower portion of the striking surface and along an upper portion of the front face proximate the toe. In some such embodiments, the front face reduced-texture zone is formed by a remainder of the front face.

In some embodiments, the rear face has a plurality of rear protrusions defining a rear face textured zone extending along a portion of rear face opposite the striking surface and along a portion of the rear face proximate the toe. The rear protrusions are shaped to be engageable with the puck to hinder slippage of the puck along the rear face when the puck is in contact with the rear protrusions. In some such embodiments, the rear face textured zone is formed along a lower portion of the rear face opposite the striking surface and along a lower portion of the rear face proximate the toe. In some such embodiments, a rear face reduced-texture zone is present and is formed by a remainder of the rear face.

In some embodiments, the front and/or rear protrusions are integrally formed in the blade. In other embodiments, the hockey stick blade further comprises a layer of synthetic material applied to the front and/or rear face and the front and/or rear protrusions are integrally formed with the layer of synthetic material. In some such embodiments, the layer of synthetic material is a layer of polyurethane.

In some embodiments, the front and/or rear protrusions generally have a shape of at least one of a cone, a truncated cone, a segment of a sphere, a pyramid, and a truncated pyramid. In some embodiments the front and/or rear textured zones have more than one of the aforementioned shapes and/or other shapes.

It should be understood that, where present, the rear protrusions, need not have the same characteristics (e.g. shape, size, structure, distribution, density, method for formation, etc.) at the front protrusions; although they may.

In some embodiments, the aforementioned hockey stick blade is unitary with the hockey stick shaft. In some such embodiments, the hockey stick blade and shaft are integrally formed.

For purposes of this application, terms used to locate elements on the blade for a hockey stick or an entire hockey stick, or their spatial orientation, such as "forwardly", "rearwardly", "front", "back", "rear", "left", "right", "up", "down", "above", and "below", are as they would normally be understood by a person normally using a hockey stick.

Embodiments of the present invention each have at least one of the abovementioned objects and/or aspects, but do not necessarily have all of them. It should be understood that some aspects of the present invention that have resulted from attempting to attain the above-mentioned objects may not satisfY these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Figure 1:
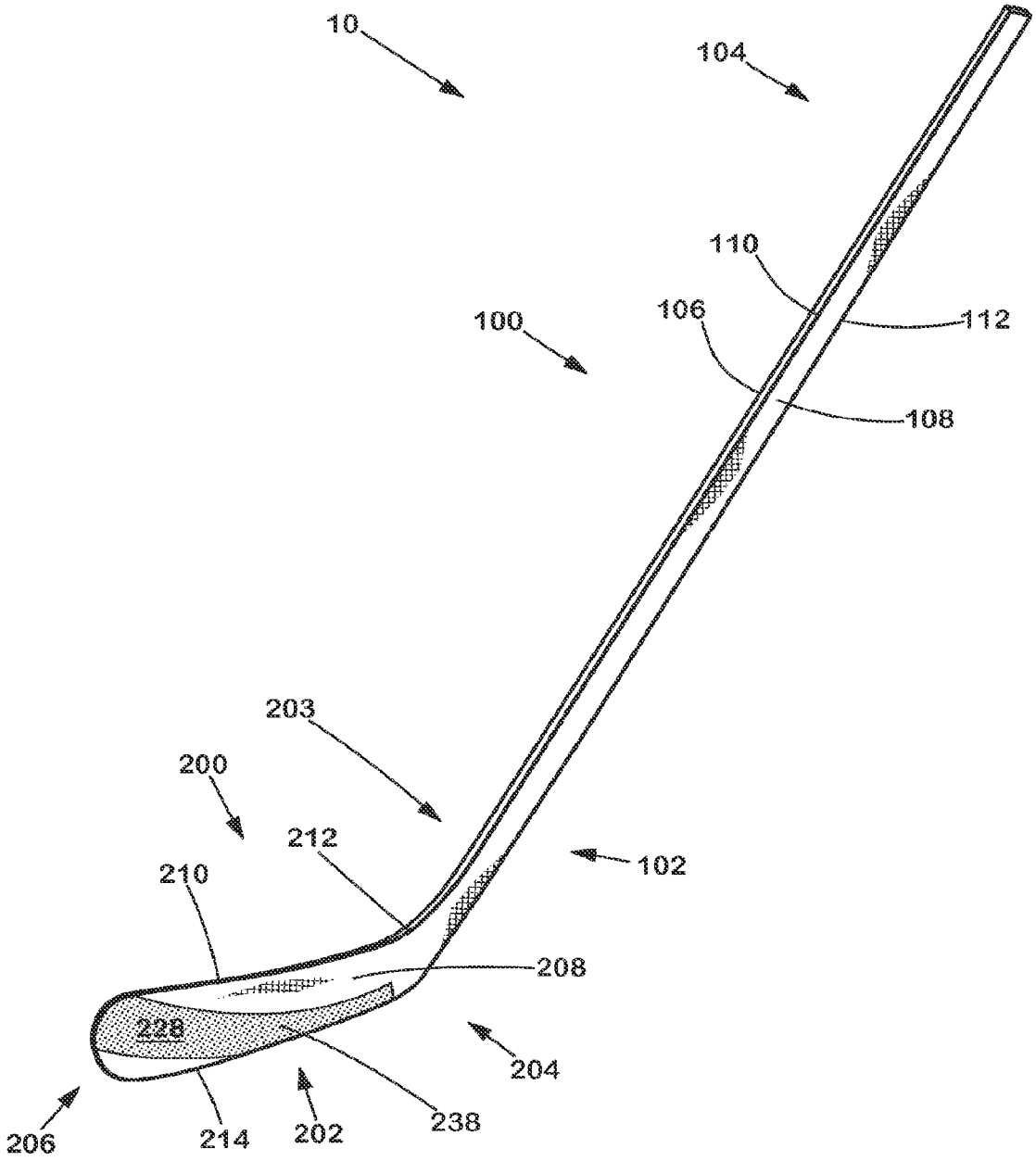
FIG. 1 is a perspective view, taken from a front, top, right side of a hockey stick according to a first embodiment.

Referring to FIG. 1, there is shown an embodiment of the present invention, hockey stick 10, which is, for example, an ice hockey stick. Hockey stick 10 is a right-handed stick. A mirror image of stick 10 would be a left-handed embodiment.

The stick 10 has a shaft 100 and a blade 200. In this embodiment the shaft 100 and blade 200 are unitary and are integrally formed (commonly referred to as "one-piece stick"). In other embodiments (not shown), the shaft and blade are separately formed, with the blade being a replaceable blade for use with a stick designed to accommodate replacement blades (commonly referred to as "two-piece sticks").

The shaft 100 has a proximal end 102 proximate the blade 200, and a distal end 104 opposite the proximal end 102. In this embodiment, the shaft 100 has a generally rectangular cross-section, having a front face 106, a rear face 108 opposite the front face 106, a top side face 110 and a bottom side face 112 opposite the top side face 110. In other embodiments the shafts have a different geometric shape (or shapes—as the case may be) in cross-section.

The blade 200 has a main blade body 202, a neck 203, a heel 204 and a toe 206. As better shown in FIGS. 2 and 3, the blade 200 has a generally rectangular crosssection (although more flat in comparison with the shaft 100) having a front face 208, a rear face 210 opposite the front face 208, a top side face 212 and a bottom side face 214 opposite the top side face 212.

In this embodiment the blade faces are continuous with their respective shaft faces. Thus, the front face 106 of the shaft 100 and the front face 208 of the blade 200 are continuous and can be considered as forming a continuous face. Similarly, in this embodiment, the rear faces 108 and 210, top side faces 110 and 212, and bottom side faces 112 and 214 are each continuous in a similar fashion.

Sticks of the present invention may be of any suitable conventional construction. In this embodiment, the stick 10 is made of superposed layers of carbon fiber reinforced fabric in a polymer matrix and the shaft 100 is hollow. In other embodiments, the various superposed layers of fiber reinforced material will include carbon fiber, glass fiber or other types of reinforcing fibers such as, for example, para-aramid synthetic fiber, or a combination thereof, and one or more polymer resins such as those known in the art can be used. In other embodiments the shaft is not hollow. In other embodiments, the stick 10 could be made of any suitable material such as solid wood, laminated wood, fibreglass-reinforced-polymer-coated wood, fiberglass-reinforced polymers, aluminum, and carbon-fiber-reinforced polymers. In one embodiment the stick is made via a conventional bladder molding process. In other embodiments, sticks may be made using any suitable conventional process.

Blades of the present invention may be of any suitable conventional construction. In this embodiment, the blade 200 comprises a core of polyurethane foam (not separately shown). In other embodiments, the blade 200 can be solely made of layers of carbon fiber reinforced fabric or other fiber reinforced fiber material.

Figure 2:
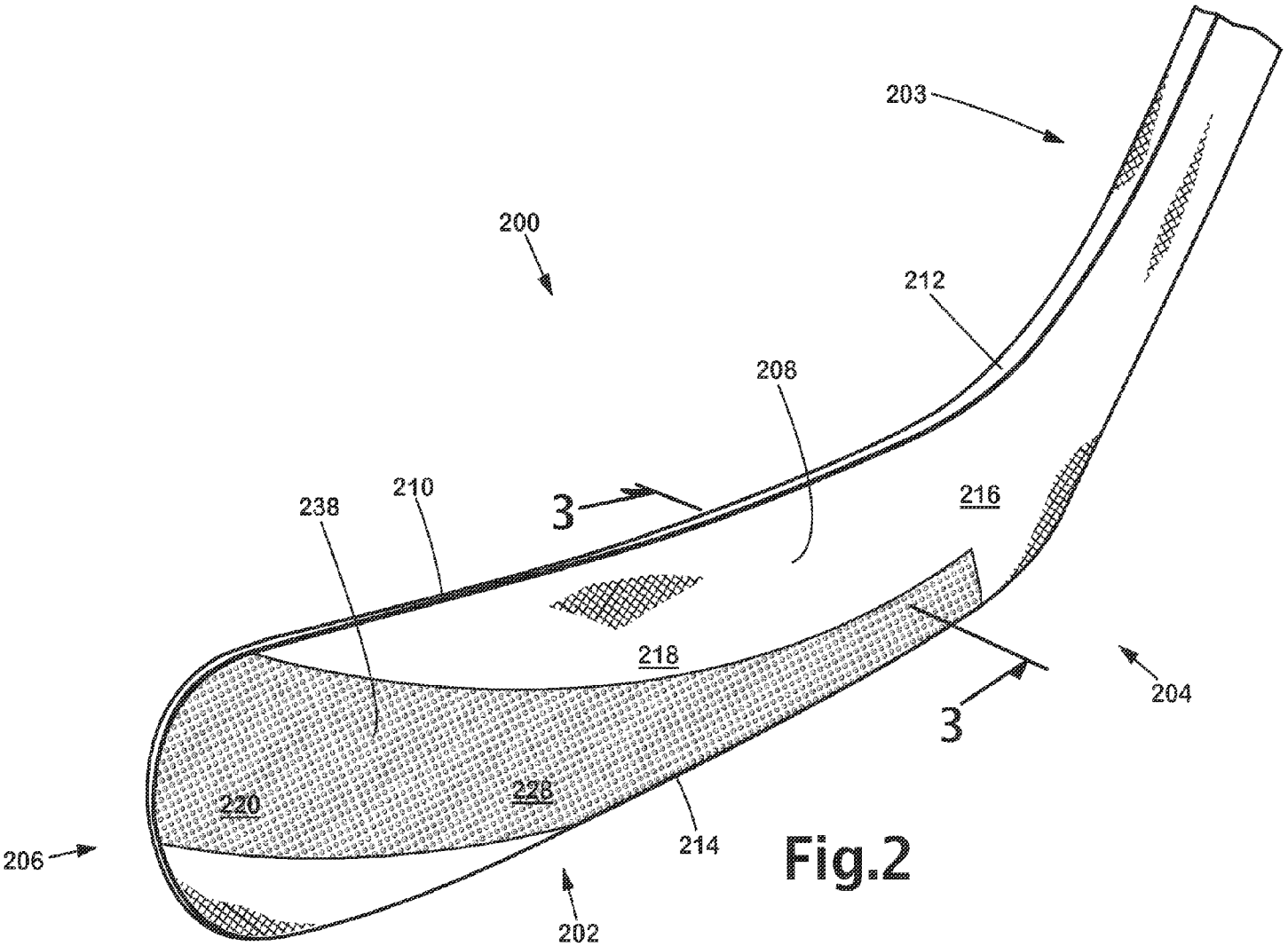
FIG. 2 is a perspective view, taken from a front, top, right side of an enlarged portion of the hockey stick of FIG. 1.
Figure 6:
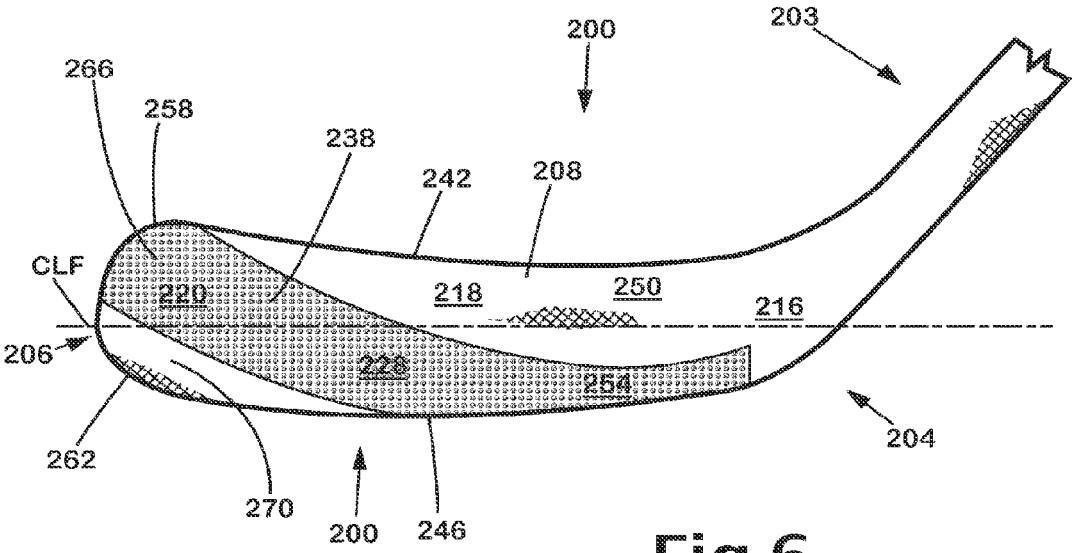
FIG. 6 is a front elevation view of the blade of the hockey stick of FIG. 1.
Figure 7:
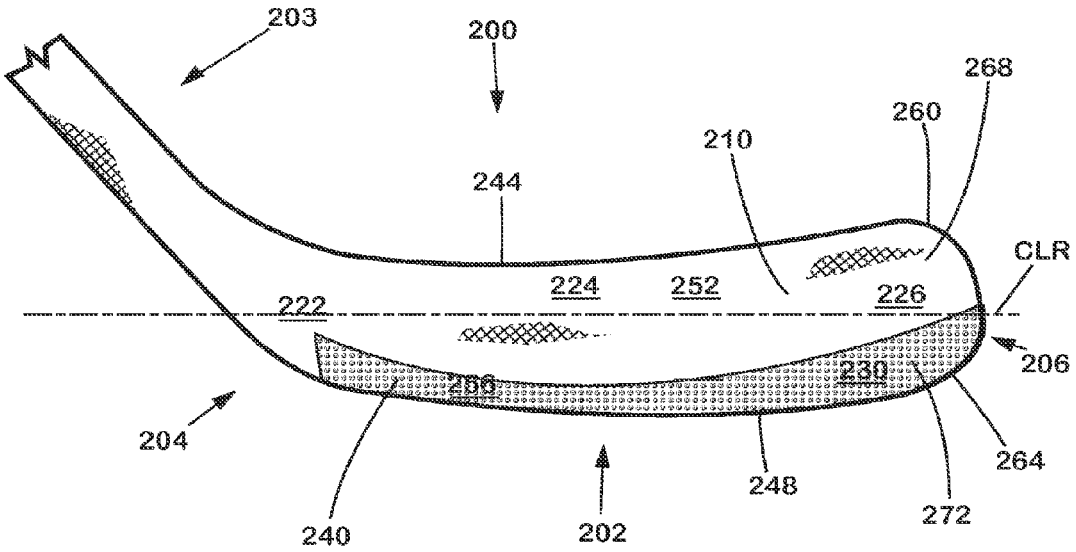
FIG. 7 is a rear elevation view of the blade of the hockey stick of FIG. 1

As shown in FIGS. 2, 6 and 7, the front face 208 has a heel portion 216 (proximate the heel 204), a toe portion 220 (proximate the toe 206), and a central portion 218 between the heel portion 216 and the toe portion 220 forming the striking surface of the blade 200. Similarly, the rear face 210 has a heel portion 222 (proximate the heel 204), a toe portion 226 (proximate toe 206), and a central portion 224 between the heel portion 222 and the toe portion 226.

A first sheet of synthetic material 228, in this embodiment a clear polyurethane decal, is applied to the front face 208 of the blade 200. The decal has the shape best shown in FIG. 6 (which will be described in further detail below). In other embodiments, the sheet of synthetic material 228 is made of another suitable material(s). Non-limiting examples of such suitable materials include papers, thermoplastic films, thermoset films, fabrics, and metallic films. The first sheet of synthetic material 228 has a plurality of protrusions 232 (which will be described in further detail below) formed by an ink that has been screen printed on the first sheet. The protrusions can comprise any suitable conventional material that can provide the desired texture. Non-limiting examples include inks, thermoplastic polymers, thermoset polymers, grains of rocks or minerals, rubbers, ceramics or combinations thereof. The protrusions can be directly formed on or in the sheet (either during formation of the sheet or after formation of the sheet) or can be separately formed and then attached to the sheet. Non-limiting examples include protrusions that are molded into the sheet as the sheet is formed, protrusions that are molded into the sheet after the sheet is formed, protrusions that are separately molded and then attached to the sheet, protrusions that are molded onto the sheet, and protrusions that are embossed into the sheet.

A second sheet of synthetic material 230 is applied to the rear face 210 of the blade 200. The second sheet of synthetic material 230 has a plurality of protrusions 232 (which will be described in further detail below) formed by an ink that has been screen printed on the first sheet. In this embodiment, the second sheet of material 230 is similar in construction to the first sheet of synthetic material 228, but has a different shape - that best shown in FIG. 7 and further described in detail below. In other embodiments, the second sheet of material and/or its protrusions are of a different construction than the first sheet of material and/or the protrusions thereof.

Figure 3:
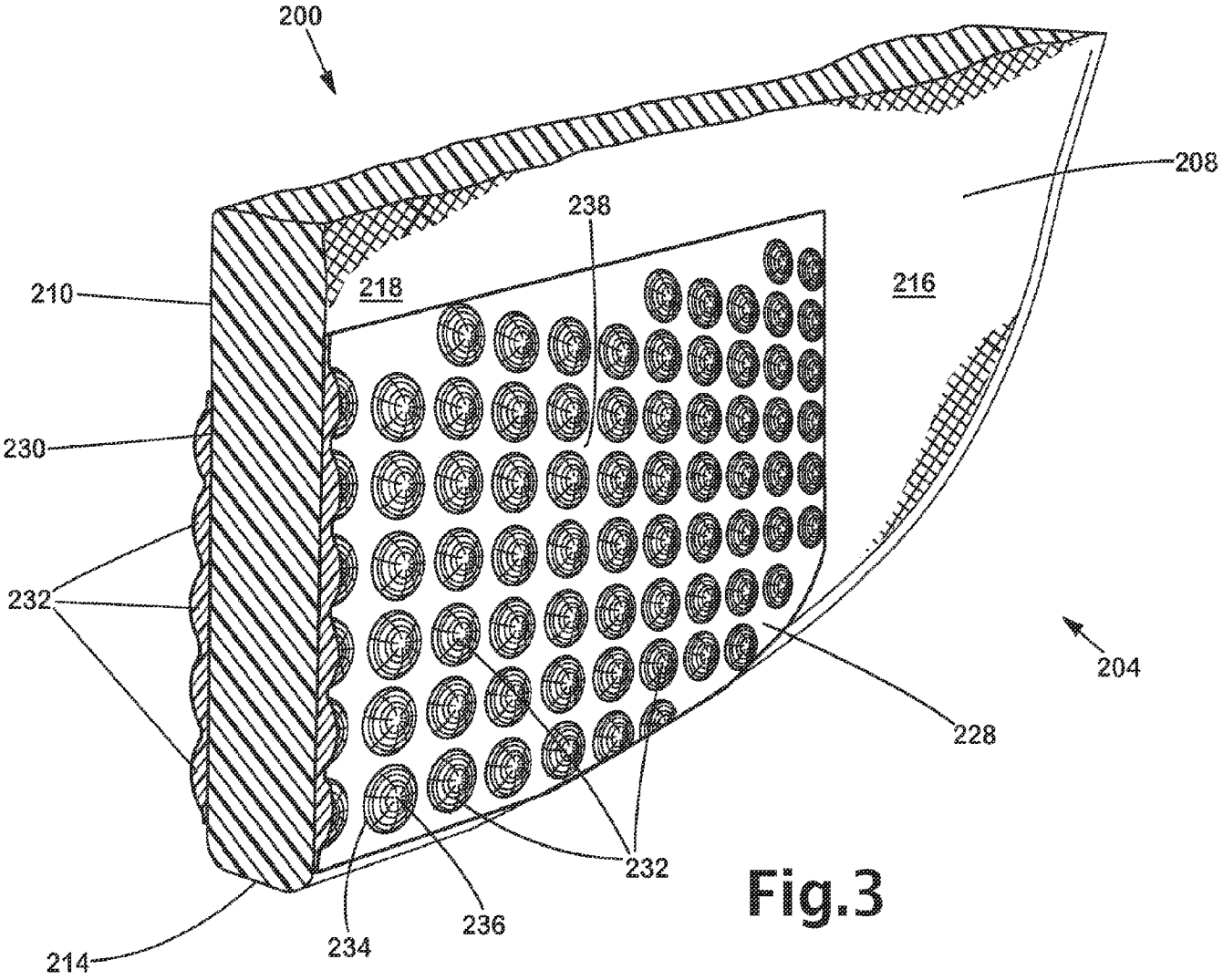
FIG. 3 is a perspective view, taken from a front, top, right side of an enlarged portion of the hockey stick of FIG. 1.

As best shown in FIG. 3, as was discussed above, the first sheet of synthetic material 228 and the second sheet of synthetic material 230 each have a plurality of protrusions 232 thereon. In this embodiment, each protrusion 232 is a segment of a sphere having a base portion 234 and a top portion 236; the base portion 234 is larger than the top portion 236. In other embodiments, the protrusions 232 have the shape of a cone, a truncated cone, a pyramid or a truncated pyramid, or other suitable shapes having a base portion larger than a top portion. Any structure providing the desired effect is possible. In some embodiments (such as the one shown) all of the protrusions 232 have the same shape and size, including those on each sheet and those on both sheets. In other embodiments at least some of the protrusions have different shapes and/or sizes on the same sheet and/or between sheets. The protrusions need not be discreet individual structures. In this respect, in some embodiments, the protrusions are ridges.

In other embodiments, the protrusions 232 could be integrally formed with the blade 200; in such embodiments, there would be no need for the first and second sheets of synthetic material 228, 230. In some such embodiments, the protrusions 232 are formed directly on the blade 200 at the same time as the blade 200 is being formed. In other such embodiments the protrusions 232 are separately formed and are integrated into the blade 200 as the blade 200 is being formed. In yet other such embodiments, the protrusions 232 are separately formed and are integrated into the blade 200 after the blade 200 is formed. In still other embodiments the blade 200 is formed and the protrusions 232 are then formed therein. (The previous examples are not intended to be limiting and in other embodiments still other means of protrusion/blade integration are possible.)

Non-limiting examples of some of the above noted embodiments include: (1) Embodiments where a mold is used to form the blade and the mold has protrusion shaped cavities such that the blade and the protrusions are molded at the same time. (2) Embodiments where a sheet or film (e.g. a non-stick sheet/film such as polytetrafluoroethylene sheet/film) having cutout portions corresponding to the desired shape(s) and size(s) of the protrusions is placed into the blade mold. When the blade is molded, resin fills the cutouts. When the blade is removed from the mold, the sheet/film is removed with protrusions integral with the surface of the blade remaining. (3) Embodiments where the protrusions are molded onto the surface of the blade after the blade has been formed. (4) Embodiments where the protrusions are machined (via embossing for example) into the surface of the blade. (5) Embodiments where the protrusions are screen printed, otherwise printed, sprayed, and/or painted onto the blade after the blade has been formed. (6) Embodiments where the protrusions are separately formed from the blade and are adhered to the blade. (7) Embodiments where the protrusions are formed on a sheet placed into the mold used to form the blade and as a result of molding the blade, the sheet becomes attached to the blade surface.

In this embodiment, a polyurethane-based varnish is applied over each of the first sheet 228 and the second sheet 230 of material (in this embodiment a decal as described hereinabove) after the relevant sheet as been adhered to the blade 200. In other embodiments, no such varnish is applied. In other embodiments a different type of coating and/or other material is present over the protrusions. In other embodiments, no coatings nor materials of any kind are present over the protrusions. Where present any such material over the protrusions (whether in the form of a varnish, coating, or otherwise) can, for example, change the friction generated by the protrusions with respect to the puck, improve the surface appearance, protect the protrusions and/or blade surface, provide a desirable surface texture, or any combination of the foregoing.

In the embodiment shown in the aforementioned figures, the first sheet of synthetic material 228 and the second sheet of synthetic material 230 are each generally completely covered by protrusions 232. (Although as can be seen in FIG. 3 there are areas of the first (front) sheet that do not have protrusions.) The protrusions 232 of the first sheet of synthetic material 228 are located on the sheet such that when the sheet is correctly applied on the front face 208 of the blade 200, the protrusions 232 together form a particular macro shape along a portion of the front face 208 such that they form a textured zone 238 corresponding to portion(s) of the blade 200 believed to be contacted by a puck during a significant number of different types of shots/maneuvers using the front face 208 that benefit from having increased friction with the blade 200. The remainder of the front face 208 forms a reduced-texture zone (which in this embodiment includes two sub-zones which are each non-textured zones) corresponding to portion(s) of the front face 208 of the blade 200 believed that during the use thereof the puck will not benefit from increased friction with the blade 200. In other embodiments, one or both of the sub-zones could be less-textured zones, which, for example, have protrusions 232 as described hereinabove but with half (or some other divisor) of the density as those of the textured-zones. (In some embodiments the less-textured zones have the same characteristics as between them, in others they have different characteristics as between them.)

The protrusions 232 of the second sheet of synthetic material 230 are located on the sheet such that when the sheet is correctly applied on the rear face 210 of the blade 200, the protrusions 232 together form a particular macro shape along a portion of the rear face 210 such that they form a textured zone 240 corresponding to portions of the blade 200 believed to be contacted by a puck during a significant number of different types of shots/maneuvers using the rear face 210 that benefit from having increased friction with the blade 200. The remainder of the rear face 210 forms a reduced-texture zone (which in this embodiment is a single continuous non-textured zone) corresponding to portions of the rear face 210 of the blade 200 believed that during the use thereof the puck will not benefit from increased friction with the blade 200.

As shown in FIGS. 6 and 7, centerlines CLF and CLR extend laterally along the front and rear blade faces 208, 210 respectively.

The central portions 218, 224 on either face 208, 210 (respectively) of the blade 200 have top edges 242, 244 (respectively) and bottom edges 246, 248 (respectively). Each central portion 218, 224 has an upper portion 250, 252 (respectively) extending from the centerline CLF and CLR (as the case may be) of the face 208, 210 (respectively) to the top edge 242, 244 (respectively). Each central portion 218, 224 has a lower portion 254, 256 (respectively) extending the centerline CLF and CLR (as the case may be) of the face 208, 210 (respectively) to the bottom edge 246, 248 (respectively).

The toe portions 220, 226 on either face 208, 210 (respectively) of the blade 200 have top edges 258, 260 (respectively) and bottom edges 262, 264 (respectively). Each toe portion 220, 226 has an upper portion 266, 268 (respectively) extending from the centerline CLF and CLR (as the case may be) of the face 208, 210 (respectively) of the face 208, 210 (respectively) to the top edge 258, 260 (respectively). Each toe portion 220, 226 has a lower portion 270, 272 (respectively) extending from the centerlines CLF and CLR (as the case may be) of the face 208, 210 (respectively) to the bottom edge 262, 264.

In this embodiment, the front textured zone 238 is disposed along a lower portion 254 of the central portion 218 of the front face 208 of the blade 200, and along the upper portion 266 of the toe portion 220 of the front face 208 of the blade. The front textured zone 238 extends along the front face 208 from the heel portion 216 to the top 25 edge 258 of the toe portion 220. The front reduced-texture zone forms the remainder of the front face 208 of the blade 200. In this respect, the front reduced-texture zone in this embodiment has two non-textured subzones; a first subzone generally being in the upper portion 250 of the central portion 218 of the front face 208 of the blade 200, and the second subzone generally being in the lower portion 270 of the toe portion 220 of the front face 208 of the blade 200.

In this embodiment, the rear textured zone 240 is disposed along a lower portion 256 of the central portion 227 of the rear face 210 of the blade 200 and along the lower portion 272 of the toe portion 226 of the rear face 210 of the blade 200. The rear textured zone 240 extends along the rear face 210 from the heel portion 222 up to the bottom edge 264 of the toe portion 226. The rear reduced-texture zone forms the remainder of the rear face 210 of the blade 200. In this respect, the rear reduced-texture zone in this embodiment is a non-textured zone that extends along the upper portion 252 of the central portion 227 of the rear face 210 and the upper portion 268 of the toe portion 226 of the rear face 210.

It is contemplated that in other embodiments, either or both of the first and second sheets of synthetic material 228, 230 (respectively) could be shaped and/or structured and the protrusions 232 disposed thereon so as to cover less than the entirety of the area of the sheet, such that when the sheet(s) disposed on the front face 208 or the rear face 210 (as the case may be) the cover(s) part of a non-textured zone of the face (208, 210) with a protrusion-less covering (so as not to create a textured zone).

Figure 4:
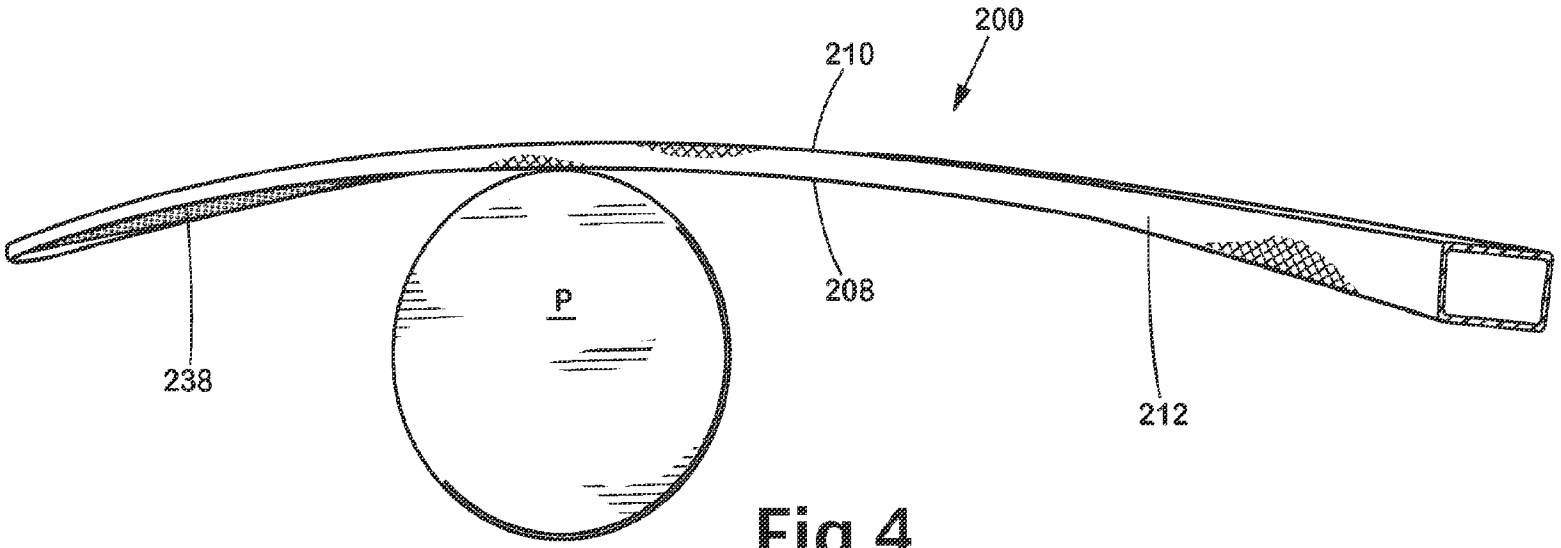
FIG. 4 is a top elevation view of the blade of the hockey stick of FIG. 1 with a puck.
Figure 5:
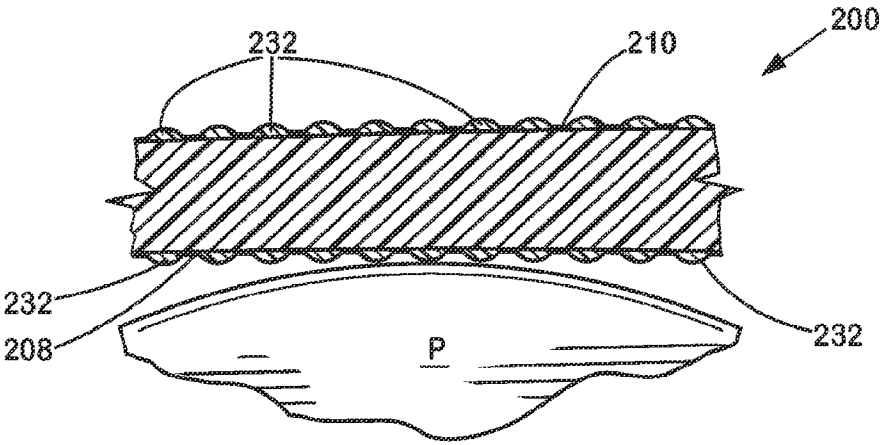
FIG. 5 is a top elevation view a portion of the blade of the hockey stick of FIG. 1 with a portion of a puck.

As shown in FIGS. 4 and 5, when a player receives the puck P with the blade 200 or is moving or shooting the puck P with the blade, the circumferential edge (unlabelled) of the puck P engages the top portion 236 of the protrusions 232 of the front face 208. It is believed (without wishing to be bound by this belief) that the particular shape of the protrusions 232 (as described above) and their disposition along the textured zone 238 as well as the location of the textured zone 238 on the front face 208 of the blade 200, will hinder the slippage of the puck P along the front face 208. Further it is also believed (without wishing to be bound by this belief) that the aforementioned will help to induce the puck P to roll along and to follow the textured zone 238 once it has engaged the blade (assuming that the movement of the stick is to this effect).

It is also believed (without wishing to be bound by this belief) that having protrusions 232 along the front textured zone 238 allows a player to induce an optimal spinning movement to the puck when he is shooting, which could stabilize the trajectory of the puck, allowing for a more accurate shot. Further, it is also believed that protrusions 232 could also improve the player's control over the puck, while allowing the player to have a good "feel" of the puck since the protrusions 232 are part of the blade.

While the aforementioned comments were in reference to the front face 208 of the blade 200, the protrusions 232 on the rear face 210 of the blade 200 are believed to provide similar advantages.

Figure 8:
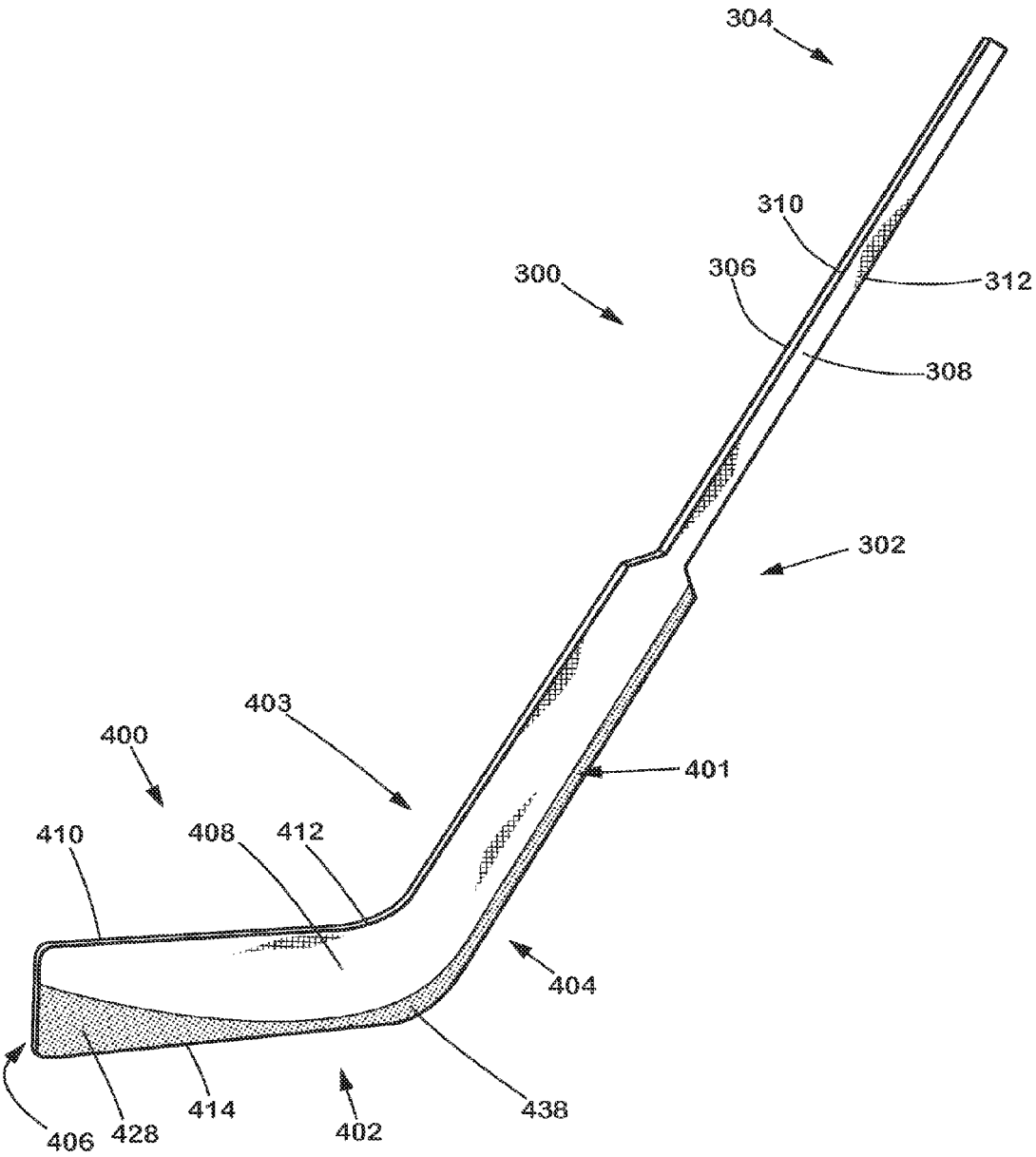
FIG. 8 is a perspective view, taken from a front, top, right side of a hockey stick according to a second embodiment.
Figure 9:
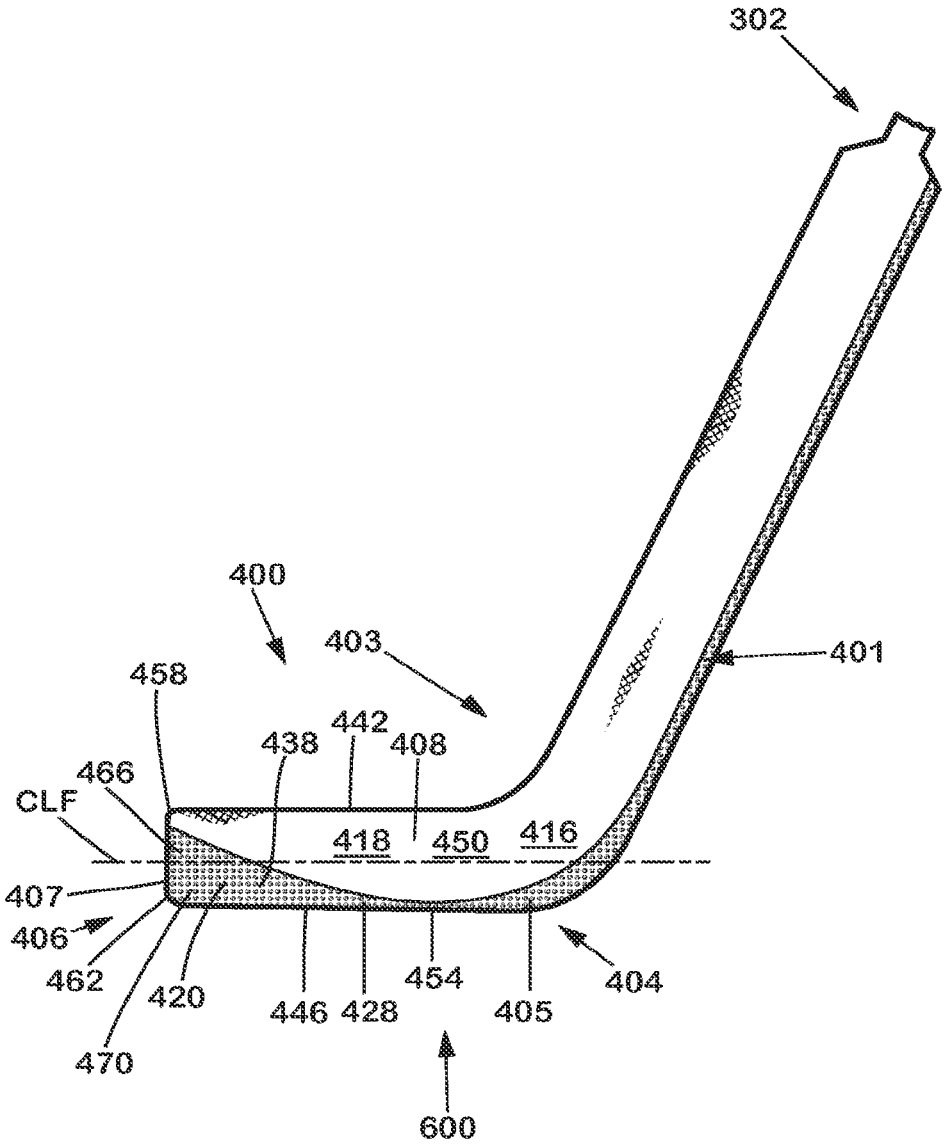
FIG. 9 is a front elevation view of the blade of the hockey stick of FIG. 8.
Figure 10:
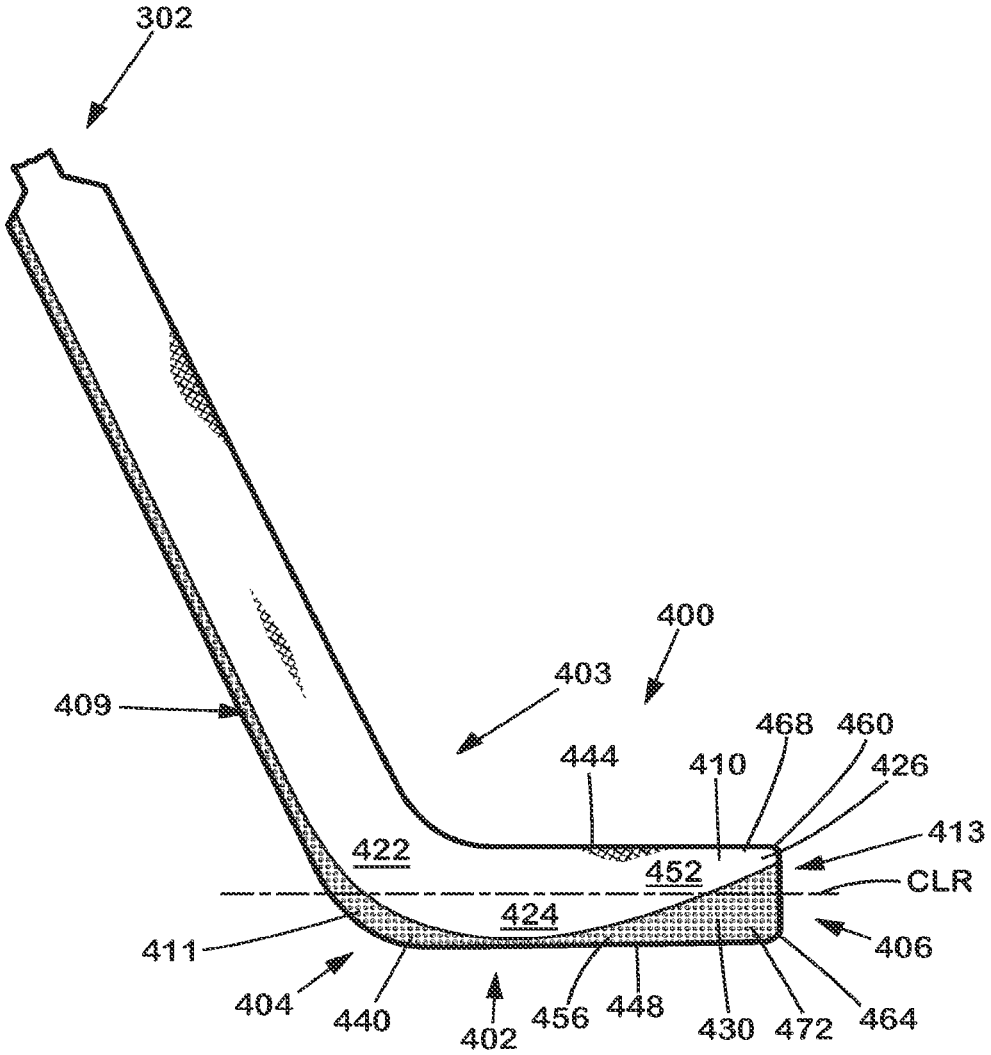
FIG. 10 is a rear elevation view of the blade of the hockey stick of FIG. 8.

As shown in FIGS. 8, 9 and 10, in another embodiment, the hockey stick is a goalie stick 300. The goalie stick 300 is similar to the hockey stick 10 except that the front and rear textured zones 338, 340 (respective) are shaped and disposed differently than on the stick 10 to account for the different use of the stick made by a hockey goalie and the different types of shots performed by a goalie. For example, a goalie mainly uses the stick 300 to block pucks shot from entering the net, to pass the puck to other players and to clear a puck from the goal crease. To these ends, the blade 400 of a goalie stick 300 is shaped differently than the blade 200 of the stick 10 and the neck 403 of the blade 400 is larger and longer than the neck 203 of the stick 10. (For ease of reference in FIGS. 8, 9, and 10, similar parts of the stick 300 and the blade 400 are labeled with the same numbering system as with respect to stick 10, with the numbering increased by 200, thus with respect to stick 300, the blade is 400 (200+200), etc.)

In this embodiment, the front textured zone 438 of the blade 400 of the stick 300 extends from a lower portion 401 of the neck portion 403 of the front face 408 of the blade 400, along a lower portion 405 of the heel portion 416, along a lower portion 454 of the central portion 418 and along the upper and lower portions 466, 470 of the toe portion 420, and up to the edge 407 of the toe portion 420. The remainder of the front face 408 of the blade 400 is a reduced-texture zone being a non-textured zone.

The rear textured zone 440 extends from a lower portion 409 of the neck portion 403 of the rear face 410 of the blade 400, along a lower portion 411 of the heel portion 422, along a lower portion 456 of the central portion 424 and the upper and lower portions 468, 472 of the toe portion 426, and up to the edge 413 of the toe portion 426. The remainder of the rear face of the blade 400 is a reduced-texture zone being a nontextured zone.

It should be note that, as can be seen in the figures, in this embodiment, the front textured zone 438 and the rear textured zone 440 are mirror images of one another, which was not the case in the first embodiment, hockey stick 10.

As was discussed herein above the present invention also includes methods of making a hockey stick 10 (or 300) with a blade 200, or an replaceable blade (not shown separate from a stick), having protrusions 232 defining front and/or rear textured zones 238, 240.

As non-limiting examples: In one embodiment such a method includes a step of applying to the front face 208 of a blade 200 a first layer of synthetic material 228, such as a polyurethane decal made by silk screening or any other printing process, and/or applying to the rear face 210 of the blade 200 a second layer of synthetic material 230, both the first and second layers of synthetic material 228, 230 having protrusions 232 integrally formed therewith as described above. In another embodiment such a method includes a step of integrally forming the protrusions 232 with the blade 200 when the blade is molded.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

The invention claimed is:

1. A hockey stick blade comprising:

a rear face;

a front face opposite the rear face, the front face having a heel portion, a toe portion spaced apart from the heel portion, and a central portion intermediate the toe and heel portions, the front face further having:

a front face textured zone defined by a plurality of front protrusions, at least part of the front face textured zone extending in the central portion from a lower edge of the blade, and a front face reduced-texture zone being less textured than the front face textured zone and extending adjacent the front face textured zone, at least part of the front face reduced-textured zone extending in the central portion from an upper edge of the blade and extending in the toe portion from the lower edge of the blade, the front face textured zone extending in the toe portion upwardly from the front face reduced-texture zone.

2. The hockey stick blade of claim 1, wherein the front face textured zone is formed along a lower portion of the central portion and along an upper portion of the toe portion.

3. The hockey stick of claim 1, wherein the front face reduced-textured zone and the front face textured zone are complementary to together define an entirety of the front face.

4. The hockey stick of claim 1, wherein the front face reduced-texture zone is a front face non-textured zone.

5. The hockey stick of claim 1, wherein the front face reduced-texture zone is textured.

6. The hockey stick blade of claim 1, further comprising a layer of synthetic material applied to the front face, the front protrusions being integrally formed with the layer of synthetic material.

7. The hockey stick of claim 6, wherein the layer of synthetic material is a layer of polyurethane.

8. The hockey stick blade of claim 1, wherein the front protrusions generally have a shape of one or more of a cone, a truncated cone, a segment of a sphere, a pyramid, and a truncated pyramid.

9. The hockey stick blade of claim 1, wherein the rear face has a plurality of rear protrusions defining a rear face textured zone extending along a central portion of the rear face opposite the central portion of the front face and along a toe portion of the rear face opposite the toe portion of the front face.

10. The hockey stick blade of claim 9, wherein the rear face textured zone is formed along a lower portion of the central portion of the rear face and along an upper portion of the toe portion of the rear face.

11. The hockey stick of claim 9, wherein the rear face further includes a rear face reduced-texture zone complementary to the rear face textured zone to together define an entirety of the rear face.

12. The hockey stick of claim 11, wherein the rear face reduced-texture zone is a rear face non-textured zone.

13. The hockey stick of claim 11, wherein the rear face reduced-texture zone is textured.

14. The hockey stick of claim 9, wherein the rear protrusions are integrally formed with the blade.

15. The hockey stick of claim 9, further comprising a layer of synthetic material applied to the rear face, the rear protrusions being integrally formed with the layer of synthetic material.

16. The hockey stick of claim 15, wherein the layer of synthetic material is a layer of polyurethane.

17. The hockey stick of claim 9, wherein the rear protrusions generally have a shape of one or more of a cone, a truncated cone, a segment of a sphere, a pyramid, and a truncated pyramid.

18. The hockey stick of claim 1, wherein the toe portion defines an upper toe portion extending a centerline to a top edge of the blade and a lower toe portion extending from the centerline to a bottom edge of the blade, the front face textured zone extending through the upper toe portion and the front reduced-texture zone extending through the lower toe portion.

19. The hockey stick of claim 1, wherein the protrusions are integrally formed with the blade.

* * * * *